US008311449B2

(12) United States Patent
Kusudo et al.

(10) Patent No.: US 8,311,449 B2
(45) Date of Patent: Nov. 13, 2012

(54) PROCESS CARTRIDGE, SUPPORTING MEMBER, PROCESS CARTRIDGE ASSEMBLING METHOD, AND PROCESS CARTRIDGE DISASSEMBLING METHOD

(75) Inventors: Ryoji Kusudo, Mishima (JP); Naoki Matsumaru, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 460 days.

(21) Appl. No.: 12/302,589

(22) PCT Filed: Jun. 26, 2007

(86) PCT No.: PCT/JP2007/063200
§ 371 (c)(1),
(2), (4) Date: Nov. 26, 2008

(87) PCT Pub. No.: WO2008/001925
PCT Pub. Date: Jan. 3, 2008

(65) Prior Publication Data

US 2009/0238603 A1 Sep. 24, 2009

(30) Foreign Application Priority Data

Jun. 26, 2006 (JP) ..... 2006-175567
Jun. 5, 2007 (JP) ..... 2007-149155

(51) Int. Cl.
*G03G 21/16* (2006.01)
*G03G 15/04* (2006.01)

(52) U.S. Cl. ..... 399/111; 399/119

(58) Field of Classification Search ..... 399/111, 399/113, 119
See application file for complete search history.

(56) References Cited

U.S. PATENT DOCUMENTS 5,450,166 A 9/1995 Yashiro ..... 355/210
6,016,413 A 1/2000 Yokoyama et al. ..... 399/113
6,934,485 B2 8/2005 Miyabe et al.
6,952,543 B2 10/2005 Kusudo ..... 399/90
6,963,706 B2 11/2005 Morioka et al. ..... 399/111
7,062,195 B2 6/2006 Kurihara et al. ..... 399/102
7,203,442 B2 4/2007 Matsubara et al. ..... 399/90
2002/0191981 A1* 12/2002 Miyabe et al. ..... 399/90

(Continued)

FOREIGN PATENT DOCUMENTS

EP 1 253 485 10/2002

(Continued)

OTHER PUBLICATIONS

Singapore Search Report and Written Opinion in Singapore Application No. 200809238-9, issued Nov. 30, 2009.

(Continued)

*Primary Examiner* — Joseph S Wong
(74) *Attorney, Agent, or Firm* — Fitzpatrick, Cella, Harper & Scinto

(57) ABSTRACT

A process cartridge detachably mountable to an image forming apparatus, the process cartridge includes an electrophotographic photosensitive member; a developer carrying member for carrying a developer to develop an electrostatic latent image formed on the electrophotographic photosensitive member; a development frame member rotatably supporting first and second longitudinal ends of the developer carrying member; a photosensitive member frame member rotatably supporting the electrophotographic photosensitive member at the first end and swingably supporting the development frame member at the first end; and a supporting member mounted to the photosensitive member frame member at the second end, the supporting member rotatably supporting the electrophotographic photosensitive member at the second end and swingably supporting the development frame member at the second end.

47 Claims, 12 Drawing Sheets

U.S. PATENT DOCUMENTS

2006/0039717 A1* 2/2006 Hatori ..... 399/111

FOREIGN PATENT DOCUMENTS

| | | | |
|---|---|---|---|
| EP | 1 253 486 | | 10/2002 |
| JP | 62-187376 | A | 8/1987 |
| JP | 8-152781 | A | 6/1996 |
| JP | 9-120251 | A | 5/1997 |
| JP | 10-20745 | A | 1/1998 |
| KR | 200200083471 | | 2/2002 |

OTHER PUBLICATIONS

Office Action for Korean Application No. 2010-004025491 mailed Jan. 28, 2010.

Office Action for corresponding Russian Application No. 2009102235 dated Feb. 17, 2010 and English translation thereof.

Chinese Office Action dated Jun. 24, 2010, in Chinese Application No. 200780024290.1, and English-language translation thereof.

Russian Office Action dated May 19, 2010, in Russian Application No. 2009102235/28(002825) and English-language translation thereof.

Singapore Search Report and Written Opinion in Singapore Application No. 200809238-9, issued Jun. 25, 2009.

Mexican Office Action for Application No. MX/a/2008/015773 dated Jun. 30, 2010, and English-language translation thereof.

International Search Report and Written Opinion of PCT/JP2007/063200 issued Oct. 15, 2007.

Office Action in Taiwanese Patent Application No. 096123105, dated Nov. 29, 2011 (with English translation).

Office Action in Mexican Patent Application No. MX/a/2008/015773, dated Nov. 11, 2011 (with partial translation).

* cited by examiner

PROCESS CARTRIDGE, SUPPORTING MEMBER, PROCESS CARTRIDGE ASSEMBLING METHOD, AND PROCESS CARTRIDGE DISASSEMBLING METHOD

TECHNICAL FIELD

The present invention relates to a process cartridge detachably attachable to an image forming apparatus, a supporting member, and a method for assembling and disassembling the process cartridge.

BACKGROUND ART

A conventional electrophotographic image forming apparatus uses an electrophotographic image forming process. Such a conventional electrophotographic image forming apparatus employs a process cartridge system in which an electrophotographic photosensitive member and a process member used for performing processing on the electrophotographic photosensitive member are integrally assembled into a cartridge, and the cartridge is detachably attached to the image forming apparatus. With such a process cartridge system, a user can perform, in effect, maintenance of an image forming apparatus by himself without asking a serviceperson for maintenance. Accordingly, a user's operability can be significantly improved. Therefore, the process cartridge system is widely used with image forming apparatuses.

The process cartridge has a configuration such that a photosensitive member unit including an electrophotographic photosensitive member swingably supports a developing unit including a developing member and a biasing member is provided to cause the developing member to contact the electrophotographic photosensitive member. Furthermore, the developing member, which serves as a process member, contacts the electrophotographic photosensitive member with a predetermined clearance or at a predetermined contact pressure.

Laid-open Japanese Patent Application Hei 09-120251 (corresponding to U.S. Pat. No. 5,450,166) discusses a method for supporting a developing unit with a photosensitive member unit. In this method, a protruding portion of an arm portion provided at both ends of the developing unit in a longitudinal direction thereof fits in a recessed portion provided on the photosensitive member unit. The photosensitive member unit is coupled to the developing unit with a coupling member having a spring member for pressing the developing unit against the photosensitive member unit.

In addition, Laid-open Japanese Patent Application Hei 10-20745 (corresponding to U.S. Pat. No. 6,016,413) discusses a method in which a fitting shaft is press-fit in holes respectively provided in an arm portion provided at both ends of a developing unit in a longitudinal direction thereof and a cleaning frame member.

DISCLOSURE OF THE INVENTION

The present invention is directed to a process cartridge having reduced number of parts. In addition, the present invention is directed to a process cartridge that can be easily assembled. Furthermore, the present invention is directed to a process cartridge that can be easily disassembled.

According to an aspect of the present invention, there is provided a process cartridge detachably mountable to an image forming apparatus, said process cartridge comprising an electrophotographic photosensitive member; a developer carrying member for carrying a developer to develop an electrostatic latent image formed on said electrophotographic photosensitive member; a development frame member rotatably supporting first and second longitudinal ends of the developer carrying member; a photosensitive member frame member rotatably supporting said electrophotographic photosensitive member at the first end and swingably supporting said development frame member at the first end; and a supporting member mounted to said photosensitive member frame member at the second end, said supporting member rotatably supporting said electrophotographic photosensitive member at the second end and swingably supporting said development frame member at the second end.

According to another aspect of the present invention there is provided a supporting member for use with a process cartridge, wherein said process cartridge includes an electrophotographic photosensitive member, a developer carrying member for carrying a developer to develop an electrostatic latent image formed on said electrophotographic photosensitive member, a development frame member rotatably supporting first and second longitudinal ends of the developer carrying member, and a photosensitive member frame member rotatably supporting said electrophotographic photosensitive member at the first end and to swingably supporting said development frame member at the first end, the improvement residing in that: said supporting member is mountable to said photosensitive member frame member at the second end, and said supporting member is effective to rotatably support said electrophotographic photosensitive member at the second end and to swingably support said development frame member at the second end.

According to a further aspect of the present invention there is provided a method for assembling a process cartridge detachably mountable to an image forming apparatus, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member, and a supporting member, said method comprising rotatably supporting said electrophotographic photosensitive member at the first end with by said photosensitive member frame member; swingably supporting said development frame member at the first end by said photosensitive member frame member; swingably supporting said development frame member at the second end by said supporting member; rotatably supporting said electrophotographic photosensitive member at the second end by said supporting member; and mounting said supporting member to said photosensitive member frame member at the second end.

According to a further aspect of the present invention, there is provided a method for disassembling a process cartridge detachably mountable to an image forming apparatus, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member rotatably supporting said electrophotographic photosensitive member at the first end and swingably supporting said development frame member at the second end, and a supporting member mounted to said photosensitive member frame member at the second end, said supporting member rotatably supporting said electrophotographic photosensitive member at the second end and swingably supporting said development frame member at the second end, said method comprising separating said supporting member from said development frame member and said electrophotographic photosensitive member at the second end and detaching said supporting member from said photosensitive member frame member at the second end; detaching said development frame member from said photosensitive member frame member at the first end; and detaching said electrophotographic photosensitive member from said photosensitive member frame member at the first end.

According to a further aspect of the present invention there is provided a method for assembling a process cartridge, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member, and a supporting member, said method comprising swingably supporting said development frame member at the first end by said photosensitive member frame member and temporarily supporting said development frame member at the second end by said photosensitive member frame member; and mounting said supporting member to said photosensitive member frame member to swingably support said development frame member by said supporting member and not to support said development frame member by said photosensitive member frame member.

According to a further aspect of the present invention there is provided a method for disassembling a process cartridge detachably mountable to an image forming apparatus, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member rotatably supporting said electrophotographic photosensitive member at the first end and swingably supporting said development frame member at the second end, and a supporting member mounted to said photosensitive member frame member at the second end, said supporting member rotatably supporting said electrophotographic photosensitive member at the second end and swingably supporting said development frame member at the second end, said method comprising separating said supporting member from said development frame member and said electrophotographic photosensitive member at the second end thereby to temporarily supporting said development frame member by said photosensitive member frame member at the second end, and dismounting said supporting member from said photosensitive member frame member at the second end; dismounting said development frame member from said photosensitive member frame member at the first and second ends.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Various exemplary embodiments, features, and aspects of the present invention will now herein be described in detail with reference to the drawings. It is to be noted that the relative arrangement of the components, the numerical expressions, and numerical values set forth in these embodiments are not intended to limit the scope of the present invention unless it is specifically stated otherwise.

An exemplary embodiment of the present invention will now be described. Hereinbelow, a process cartridge and an electrophotographic image forming apparatus to which the process cartridge is detachably attached according to the present exemplary embodiment will be described with reference to the drawings.

In the present exemplary embodiment, an electrophotographic image forming apparatus configured to form an image on an electrophotographic photosensitive member using an electrophotographic image forming process and a process cartridge detachably attached to the electrophotographic image forming apparatus are described as an example.

First, an exemplary configuration of the electrophotographic image forming apparatus will be described with reference to FIG. 2 and FIG. 3.

Figure 2:
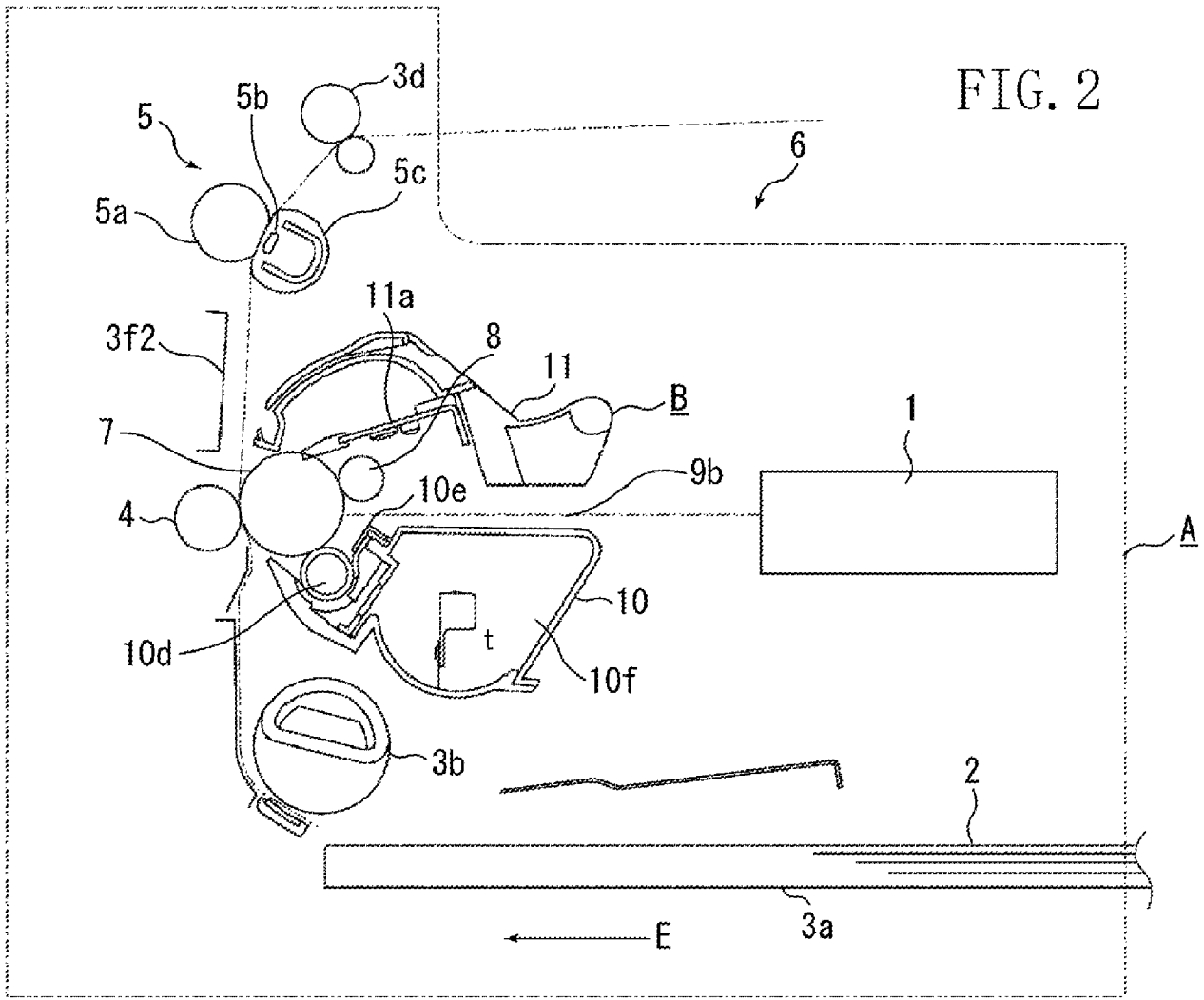
FIG. 2 is a sectional side view illustrating an exemplary configuration of an electrophotographic image forming apparatus according to an exemplary embodiment of the present invention.

FIG. 2 illustrates a side cross section of the image forming apparatus having the process cartridge attached thereto according to the present exemplary embodiment. FIG. 3 illustrates a side cross section of the process cartridge according to the present exemplary embodiment.

Image forming by the electrophotographic image forming apparatus according to the present exemplary embodiment will be described here. First, as illustrated in FIG. 2, a laser light image formed based on image information is irradiated from an optical system 1 onto an electrophotographic photosensitive member (hereinafter referred to as a "photosensitive drum") 7, which is shaped in a drum-like shape having a photosensitive layer. Thus, an electrostatic latent image is formed on the photosensitive drum 7.

Voltage is applied to a developing roller 10*d*, which is a developer carrying member for bearing thereon a developer t, and thus the developer t is transferred onto the photosensitive drum 7 from the developing roller 10*d*. Thus, an image of the developer t is formed on the photosensitive drum 7. A recording material 2, which is a recording medium (a recording sheet, an overhead projector (OHP) sheet, or the like), is conveyed from a cassette 3*a* by a conveyance member 3*b* in synchronization with the forming of the developer image.

Then, the developer image, which is formed on the photosensitive drum 7 by an image forming unit provided as a process cartridge (hereinafter simply referred to as a "cartridge") B, is transferred onto the recording material 2 according to application of a voltage to a transfer roller 4, which is a transfer member. The recording material 2 is then guided by a guide plate 3*f*2 to be conveyed to a fixing member 5. The fixing member 5 includes a drive roller 5*a* and a fixing roller 5*c* containing a heater 5*b*.

The recording material 2, which has passed through the fixing roller 5*c*, is conveyed by a discharge roller pair 3*d* and then is discharged to a discharge portion 6 via a reverse conveyance path. In the image forming apparatus, the recording material 2 can be fed via a manual feed tray (not shown) and a roller (not shown).

The cartridge B includes the photosensitive drum 7 and a process member, which includes at least the developing roller 10*d* for developing an electrostatic latent image formed on the photosensitive drum 7.

Figure 3:
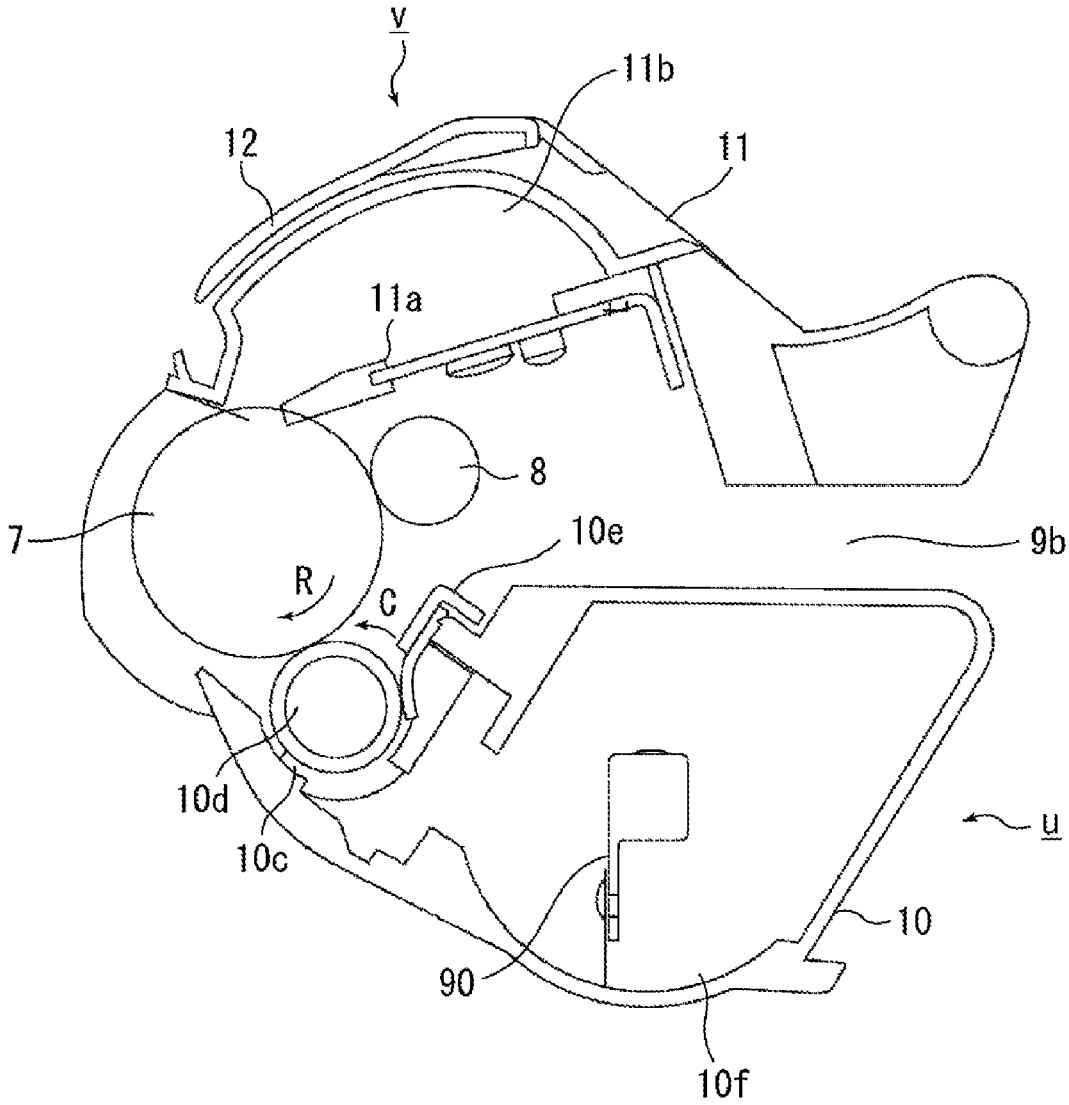
FIG. 3 is a sectional side view illustrating a configuration of the process cartridge according to an exemplary embodiment of the present invention.

As illustrated in FIG. 3, in forming an image using the cartridge B according to the present exemplary embodiment, the photosensitive drum 7 rotates in a direction indicated by an arrow R. The surface of the photosensitive drum 7 is evenly charged by a charging roller 8, which is a charging member.

Light emitted from the optical system 1 passes through an exposure opening portion 9*b* included in a cleaning frame member 11, which is a photosensitive member frame member, so as to expose the circumferential surface of the photosensitive drum 7. An electrostatic latent image is thus formed on the photosensitive drum 7. A development vessel 10 includes a developer restriction member (developing blade) 10*e* and the developing roller 10*d*.

In addition, the development vessel 10 includes a developer storing portion 10*f* for storing the developer t to be supplied to the developing roller 10*d*. The developer t on the developing roller 10*d* is restricted by the developing blade 10*e*, and thus an even developer layer is formed on the developing roller led.

By applying a developing bias voltage to the developing roller 10*d*, the developer t is transferred onto the photosensitive drum 7 according to the formed latent image. Thus, a developer image according to the latent image is formed on the photosensitive drum 7. The formed developer image is transferred onto the recording material 2 when a transfer bias voltage is applied to the transfer roller 4.

The developer t remaining on the surface of the photosensitive drum 7 after the developer image is transferred onto the recording material 2 is removed by a cleaning blade 11*a*, which is a cleaning member. The removed developer t is collected into a removed developer storage portion 11*b*.

A protective shutter 12 is attached to the cleaning frame member 11 to protect the photosensitive drum 7. The protective shutter 12 is configured to move between a protective position to cover the photosensitive drum 7 when the cartridge B is not in use and an exposure position to expose the photosensitive drum 7 from the surface of the cartridge B when the cartridge B is in use (when the cartridge B is mounted in the image forming apparatus body) as illustrated in FIG. 3.

Figure 1:
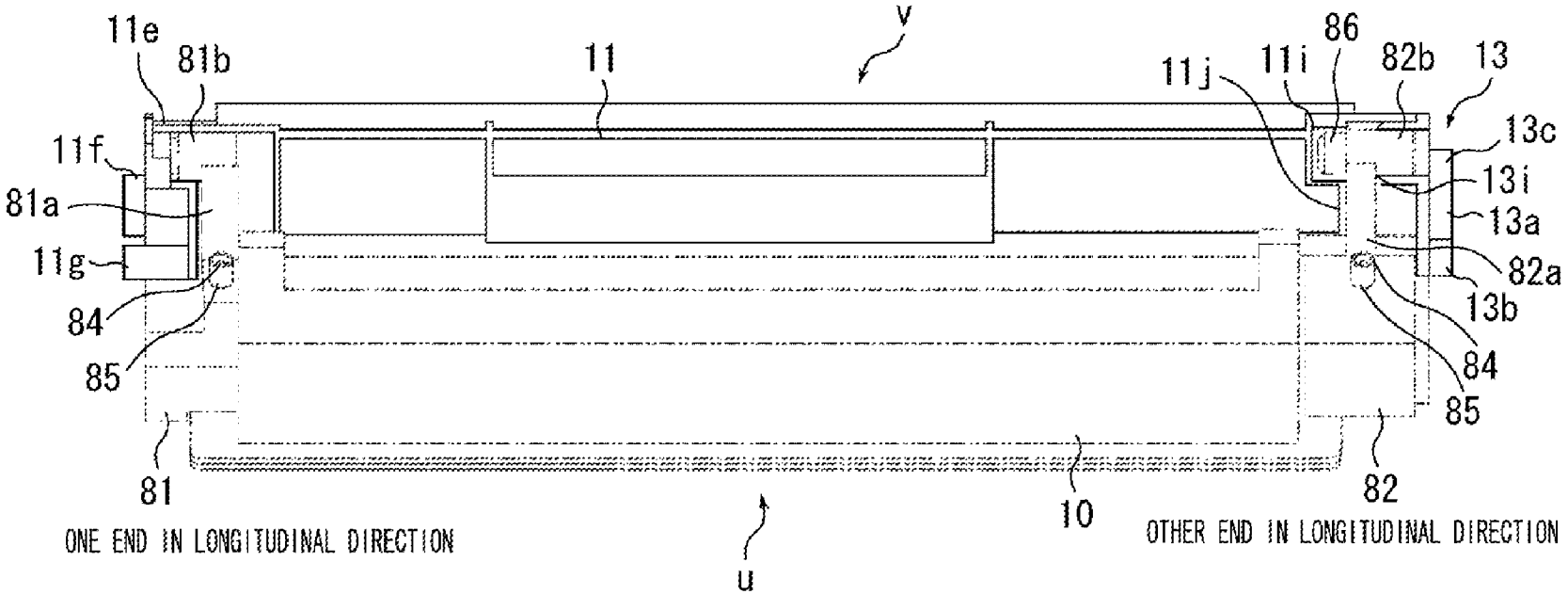
FIG. 1 is a sectional view illustrating an exemplary configuration of a process cartridge according to an exemplary embodiment of the present invention.
Figure 4:
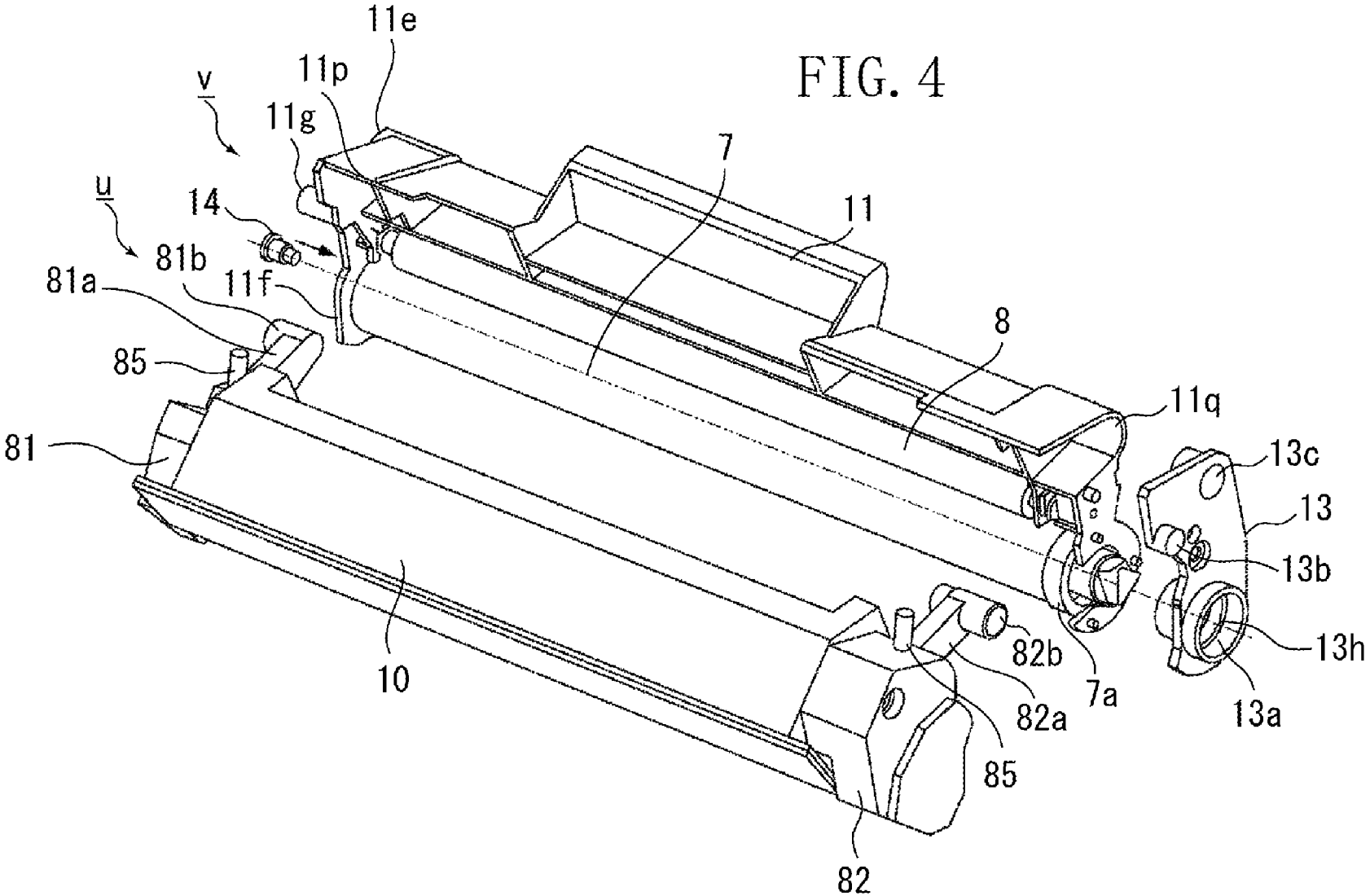
FIG. 4 is a perspective view illustrating a configuration of the process cartridge according to an exemplary embodiment of the present invention.

As illustrated in FIG. 1 and FIG. 4, the cartridge B includes a photosensitive member unit v, which is a first unit, a developing unit u, which is a second unit, and a supporting member 13. The photosensitive member unit v includes the cleaning frame member 11, the photosensitive drum 7, the charging roller 8, and the cleaning blade 11*a*.

The developing unit u includes a development frame member and the developing roller 10*d*. The development frame member includes the development vessel 10 and end portion members 81 and 82. The end portion members 81 and 82 are fixed at both ends of the development vessel 10 in the longitudinal direction thereof to support the developing roller 10*d*. Thus, the development frame member (the development vessel 10 and the end portion members 81 and 82) rotatably supports both ends of the developing roller 10*d* in the longitudinal direction. In addition, the supporting member 13 rotatably supports the photosensitive drum 7 and the developing unit u in cooperation with the cleaning frame member 11.

An exemplary configuration for supporting the developing unit u with the photosensitive member unit v will now be described below. As illustrated in FIG. 4, the developing unit u includes the development vessel 10 and the end portion members 81 and 82. The end portion members 81 and 82 are attached to the development vessel 10 in the longitudinal direction, respectively. The end portion members 81 and 82 include an arm portion 81*a* and an arm portion 82*a*, respectively.

The arm portions 81*a* and 82*a* protrude towards the photosensitive member unit v (in a direction crossing the longitudinal direction of the development vessel 10). At front edges of the arm portions 81*a* and 82*a*, a fulcrum shaft 81*b*, which is a one-end (first-end) portion to be supported (one-end supported portion), and a fulcrum shaft 82*b*, which is an another-end (second-end) portion to be supported (another-end supported portion), are respectively provided. In the present exemplary embodiment, the fulcrum shafts 81*b* and 82*b* are cylindrically shaped.

At the one end, the photosensitive drum 7 is rotatably supported by a drum shaft 14, which is a photosensitive member supporting portion, provided on the cleaning frame member 11. In addition, at the other end, the photosensitive drum 7 is rotatably supported by a shaft bearing portion 13*h*, which is a second supporting portion.

The supporting member 13 includes the shaft bearing portion 13*h*. At the one end, the drum shaft 14 is press-fit in a hole (not shown) provided on a first portion to be guided (first guided portion) 11*f*. The first guided portion 11*f* is disposed at the one end of the cleaning frame member 11.

At the other end, the supporting member 13 is attached to the cleaning frame member 11. That is, the cleaning frame member 11 rotatably supports the photosensitive drum 7 at the one end. On the other hand, the supporting member 13 rotatably supports the photosensitive drum 7 at the other end.

At the one end, the cleaning frame member 11 has a fitting hole 11*e*, which is a one-end supporting portion. In addition, as illustrated in FIG. 4, the supporting member 13 has a fitting hole 13*c*, which is a first supporting portion. The fulcrum shafts 81*b* and 82*b* are fitted in the fitting holes 11*e* and 13*c*, respectively. Thus, at the one end, the fitting hole 11*e* rotatably supports the fulcrum shaft 81*b*, and at the other end, the fitting hole 13*c* swingably supports the fulcrum shaft 82*b*. At the other end, the supporting member 13 swingably supports the development frame member.

That is, the developing unit u is rotatably (swingably) supported by the photosensitive member unit v. At this time, the position of the arm portion 82*a*, which is a portion to be restricted (restricted portion), in the longitudinal direction is restricted between a longitudinal direction restriction portion 11*j*, which is provided on the cleaning frame member 11 at the other end, and an arm abutting portion 13*i*, which is a restriction portion provided on the supporting member 13. Thus, the position of the developing unit u in the longitudinal direction with respect to the photosensitive member unit v is restricted.

Figure 5:
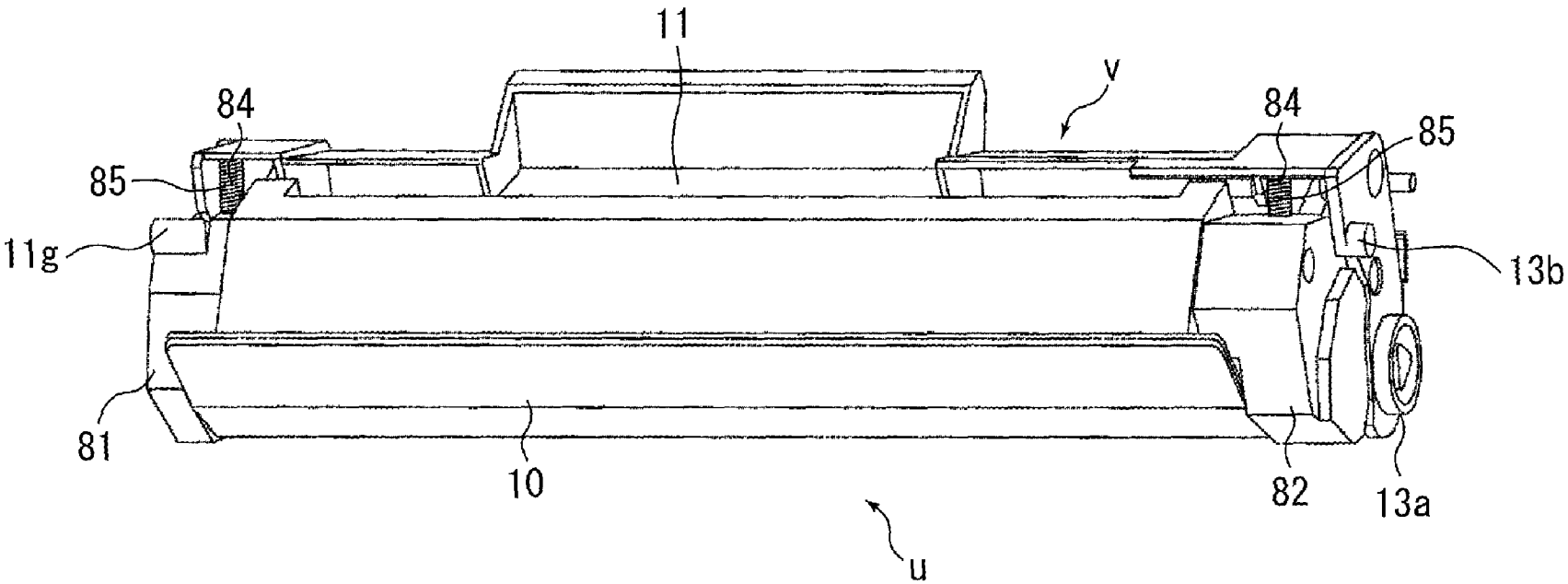
FIG. 5 is a perspective view illustrating the process cartridge according to an exemplary embodiment of the present invention.

In addition, as illustrated in FIG. 5, a compression coil spring 85, which is a biasing member, is fit around a spring holder 84, which is provided on each of the end portion members 81 and 82. The spring 85 is disposed (compressed) between each of the end portion members 81 and 82 and the cleaning frame member 11.

Thus, the developing unit u is urged towards the photosensitive drum 7, and a ring-like clearance maintaining member 10*c* (FIG. 3), which is provided on both ends of the developing roller 10*d*, contacts the photosensitive drum 7. Thus, the developing roller 10*d* and the photosensitive drum 7 oppose each other with a predetermined clearance.

With the above-described configuration, according to the present exemplary embodiment, the photosensitive member unit v can swingably support the developing unit u without the need to use a connection pin or the like. In addition, at the above-described other end, the supporting member 13 supports both the photosensitive drum 7 and the developing unit u (the fulcrum shaft 82*b*). Accordingly, the relative position of the photosensitive drum 7 to the developing roller 10*d*, which is supported by the developing unit u, can be accurately determined.

Furthermore, to transfer a driving force from an apparatus body A to the photosensitive drum 7, a drum gear 7*a* is provided on the photosensitive drum 7 at the other end. In addition, to transfer the driving force from the apparatus body A to the developing roller 10*d*, a developing roller gear (not shown) is attached to the other end of the developing roller 10*d* in the longitudinal direction.

In addition, an idler gear (not shown) for transferring the driving force from the developing roller gear to a conveyance gear (not shown) of a developer conveyance member 90 (FIG. 3) is provided at the other end. The end portion member 82 covers a gear train (not shown) including the developing roller gear, the conveyance gear, and the idler gear.

Figure 6:
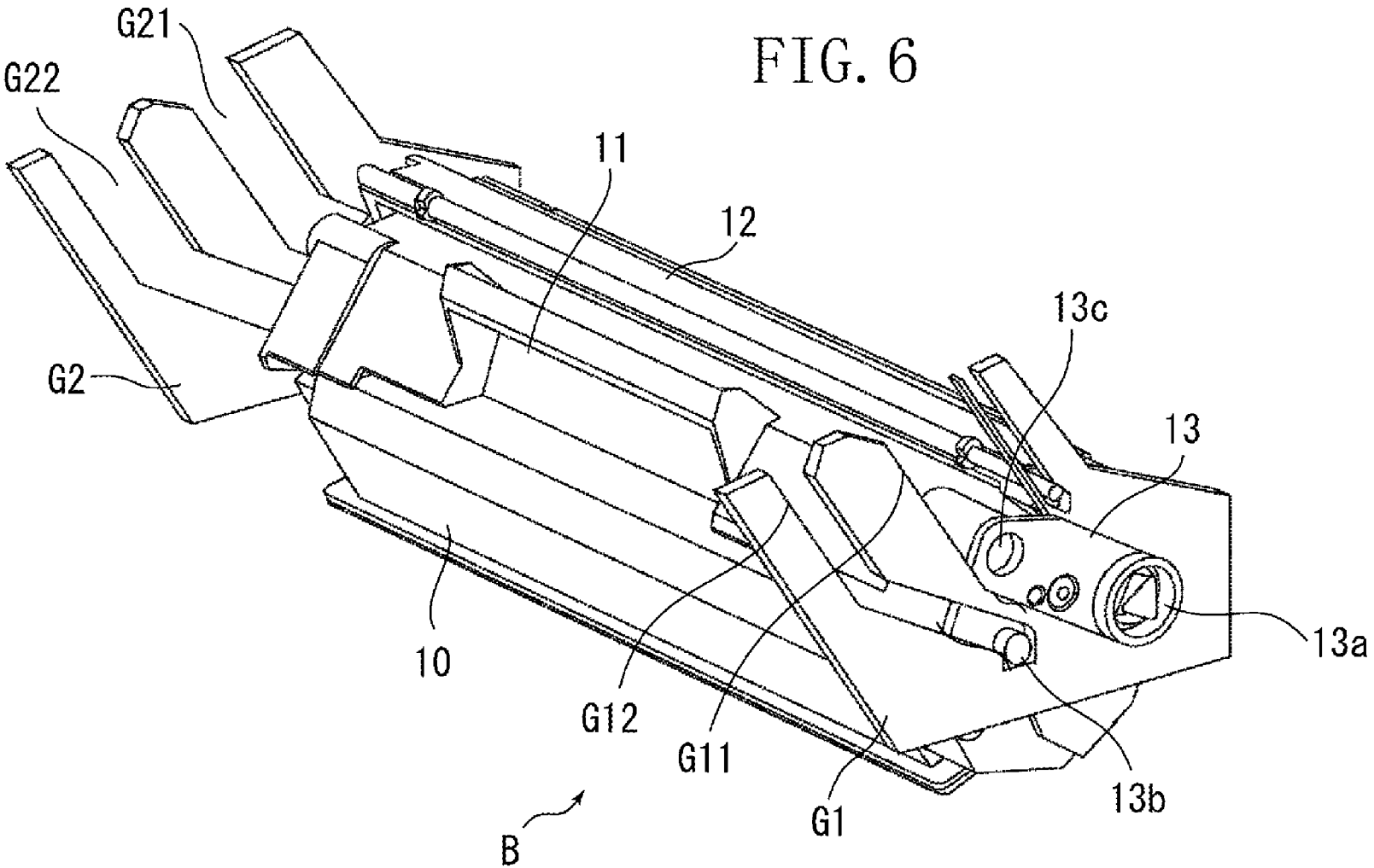
FIG. 6 is a perspective view illustrating a process cartridge mounting guide in the image forming apparatus according to an exemplary embodiment of the present invention.
Figure 7:
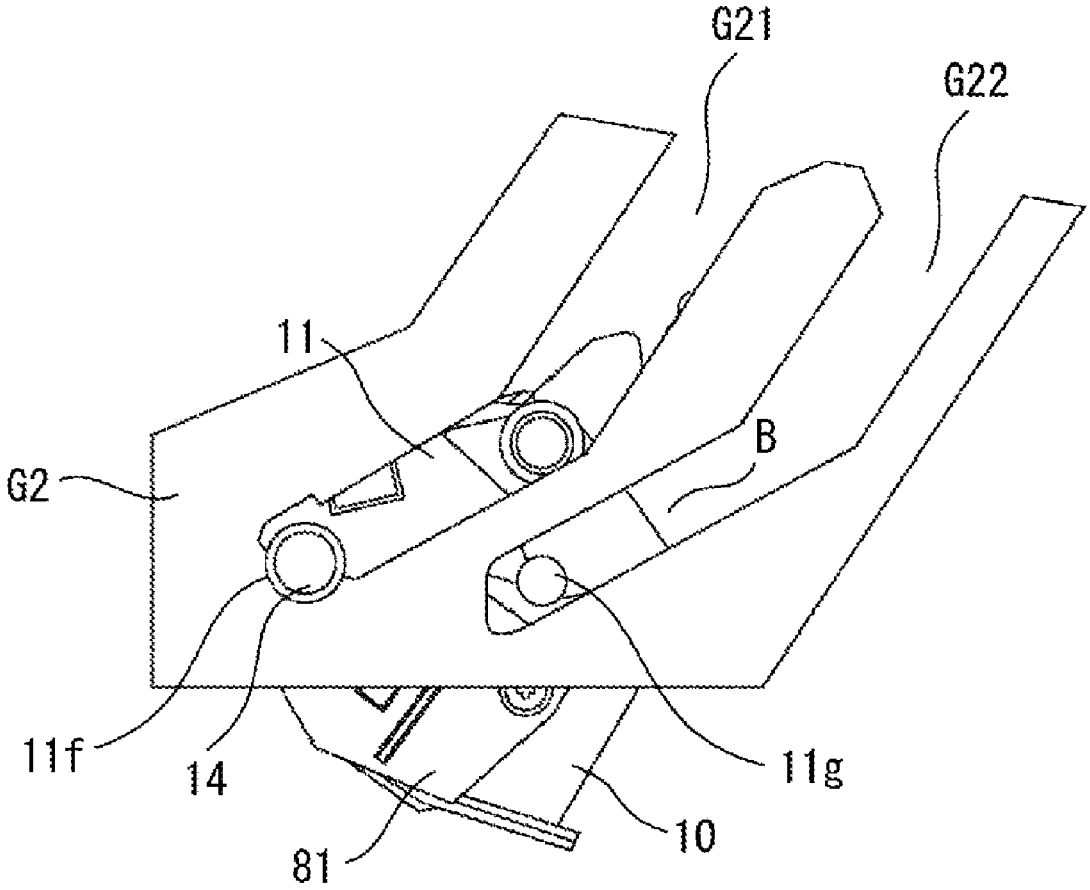
FIG. 7 is a side view illustrating the process cartridge mounting guide in the image forming apparatus according to an exemplary embodiment of the present invention.

An exemplary configuration of a guide member used in attaching and detaching the cartridge B to and from the apparatus body A will now be described below. FIG. 6 and FIG. 7 are a perspective view and a left side view, respectively, illustrating the process cartridge B mounted into the apparatus body A and body guide members G1 and G2.

On both outer sides of the cartridge B in the longitudinal direction, portions to be guided, which are guided during mounting and demounting of the cartridge B to and from the apparatus body A, are provided. The portions to be guided include a first portion to be guided (first guided portion) 11*f*, which is a positioning portion, a second portion to be guided (second guided portion) 11*g*, which is a rotation restriction portion, a third portion to be guided (third guided portion) 13*a*, which is a positioning portion, and a fourth portion to be guided (fourth guided portion) 13*b*, which is a rotation restriction portion.

The first guided portion 11*f* and the second guided portion 11*g* are provided on one end of the cleaning frame member 11 in the longitudinal direction. The third guided portion 13*a* and the fourth guided portion 13*b* are provided on the supporting member 13. The body guide members G1 and G2 for guiding the portions to be guided are provided on the apparatus body A.

The first guided portion 11*f* and the third guided portion 13*a* have a cylindrical shape and are provided on side surfaces of the photosensitive member unit v. In addition, the first guided portion 11*f* and the third guided portion 13*a* protrude outward along the same axis as the center axis of the photosensitive drum 7. The second guided portion 11*g* and the fourth guided portion 13*b* also protrude outward from the side surfaces of the photosensitive member unit v.

In mounting the cartridge B into the apparatus body A, the first guided portion 11*f* and the second guided portion 11*g* are guided into guide grooves G21 and G22 of the body guide member G2, respectively, and the third guided portion 13*a* and the fourth guided portion 13*b* are guided into guide grooves G11 and G12 of the body guide member G1, respectively.

Thus, the cartridge B is guided to the mounting position of the apparatus body A. At the mounting position, the second guided portion 11*g* and the third guided portion 13*a*, which are on the same axis as the axis of the photosensitive drum 7, are rotatably positioned in the apparatus body A. The fourth guided portion 13*b*, which is a rotation restriction portion, contacts the guide groove G12. Thus, the rotation of the cartridge B is restricted, and a mounting attitude of the cartridge B in the apparatus body A is determined.

Figure 8:
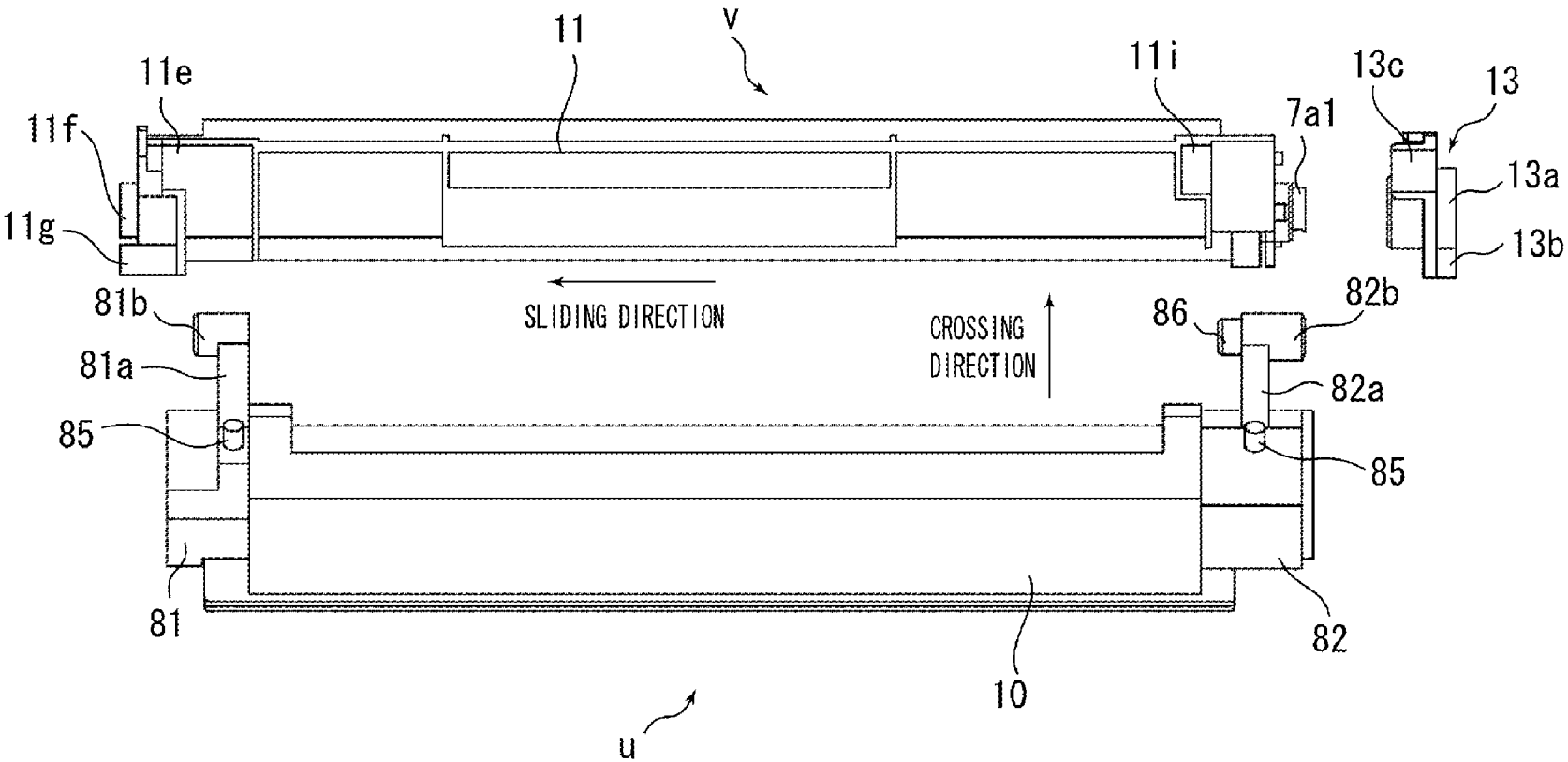
FIG. 8 is a sectional view illustrating an assembling configuration of a developing unit and a photosensitive member unit in the process cartridge according to an exemplary embodiment of the present invention.

A method for assembling the process cartridge B according to the present exemplary embodiment will now be described below with reference to FIG. 1 and FIG. 8. At both ends of the developing unit u in the longitudinal direction, the end portion members 81 and 82 are respectively provided. The end portion members 81 and 82 include the fulcrum shafts 81*b* and 82*b*, respectively. The fulcrum shafts 81*b* and 82*b* are fitted in the fitting hole 11*e* provided on the cleaning frame member 11 and the fitting hole 13*c* provided on the supporting member 13, respectively. Thus, the developing unit u is swingably supported by the cleaning frame member 11.

The procedure for assembling the process cartridge B will be described below.

i) Photosensitive Member Supporting Step

First, the photosensitive drum 1 is rotatably supported by the cleaning frame member 11 at the one end.

ii) Frame Member Supporting Step I

At a position where the development frame member is shifted, with respect to the cleaning frame member 11, to a position closer to the other end in the longitudinal direction from a normal position illustrated in FIG. 1, the development frame member and the cleaning frame member 11 are moved closer to each other in a direction crossing the longitudinal direction. Thus, the arm portions 81*a* and 82*a* enter recessed portions 11*p* and 11*q* (FIG. 4), respectively, provided on the cleaning frame member 11.

iii) Frame Member Supporting Step II

Then, the developing unit u is slid towards the one end from the other end. Thus, the fulcrum shaft 81*b* fits into the fitting hole 11*e* of the cleaning frame member 11 at the one end. Thus, the fulcrum shaft 81*b* is swingably supported by the fitting hole 11*e*. Further, a guide boss 86, which is a portion to be temporarily supported provided on the end portion member 82, is temporarily supported by a guide hole 11*i*, which is a temporary supporting portion provided on the photosensitive member unit v at the other end. Thus, the developing unit u moves to the normal position with respect to the photosensitive member unit v.

iv) Supporting Member Attaching Step

Subsequently, the supporting member 13 is attached to the cleaning frame member 11 at the other end. At this time, the fulcrum shaft 82*b* fits into the fitting hole 13*c*. That is, the fitting hole 13*c* swingably supports the fulcrum shaft 82*b* at the other end. Then, a shaft portion 7*a*1 of the drum gear 7*a* fits into the shaft bearing portion 13*h*.

That is, at the other end, the shaft bearing portion 13*h* rotatably supports the shaft portion 7*a*1. The supporting member 13 is fixed to the cleaning frame member 11 with a screw or by limonene bonding or resin bonding. A clearance (play) between the outer circumference of the guide boss 86 and the inner circumference of the guide hole 11*i* is larger than a clearance (play) between the outer circumference of the fulcrum shaft 82*b* and the inner circumference of the fitting hole 13*c*.

Thus, the fulcrum shaft 82*b* can be supported by the fitting hole 13*c* without causing the guide hole 11*i* to support the guide boss 86. No clearance can be provided between the outer circumference of the fulcrum shaft 82*b* and the inner circumference of the fitting hole 13*c*.

That is, the guide boss 86 and the guide hole 11*i* function to prevent the development frame body from disengaging before the supporting member 13 is attached to the cleaning frame member 11 (that is, to improve assembling performance). When the supporting member 13 is attached to the cleaning frame member 11, the fulcrum shaft 82*b* and the fitting hole 13*c* are positioned with a clearance between them.

That is, supporting of the fitting hole 13*c* by the fulcrum shaft 82*b* is released. Thus, the guide boss 86 and the guide hole 11*i* can function to temporarily position the supporting member 13 before the supporting member 13 is attached to the cleaning frame member 11. That is, the guide boss 86 temporarily supports the guide hole 11*i*.

At this time, an elastic member (not shown), such as a Moltprene, can be provided on either of or both of the fulcrum shaft 82*b* and the fitting hole 13*c*. In this case, the fulcrum shaft 82*b* and the fitting hole 13*c* are in contact with each other. Thus, the fulcrum shaft 82*b* and the fitting hole 13*c* can function as a temporary positioning member.

Figure 9:
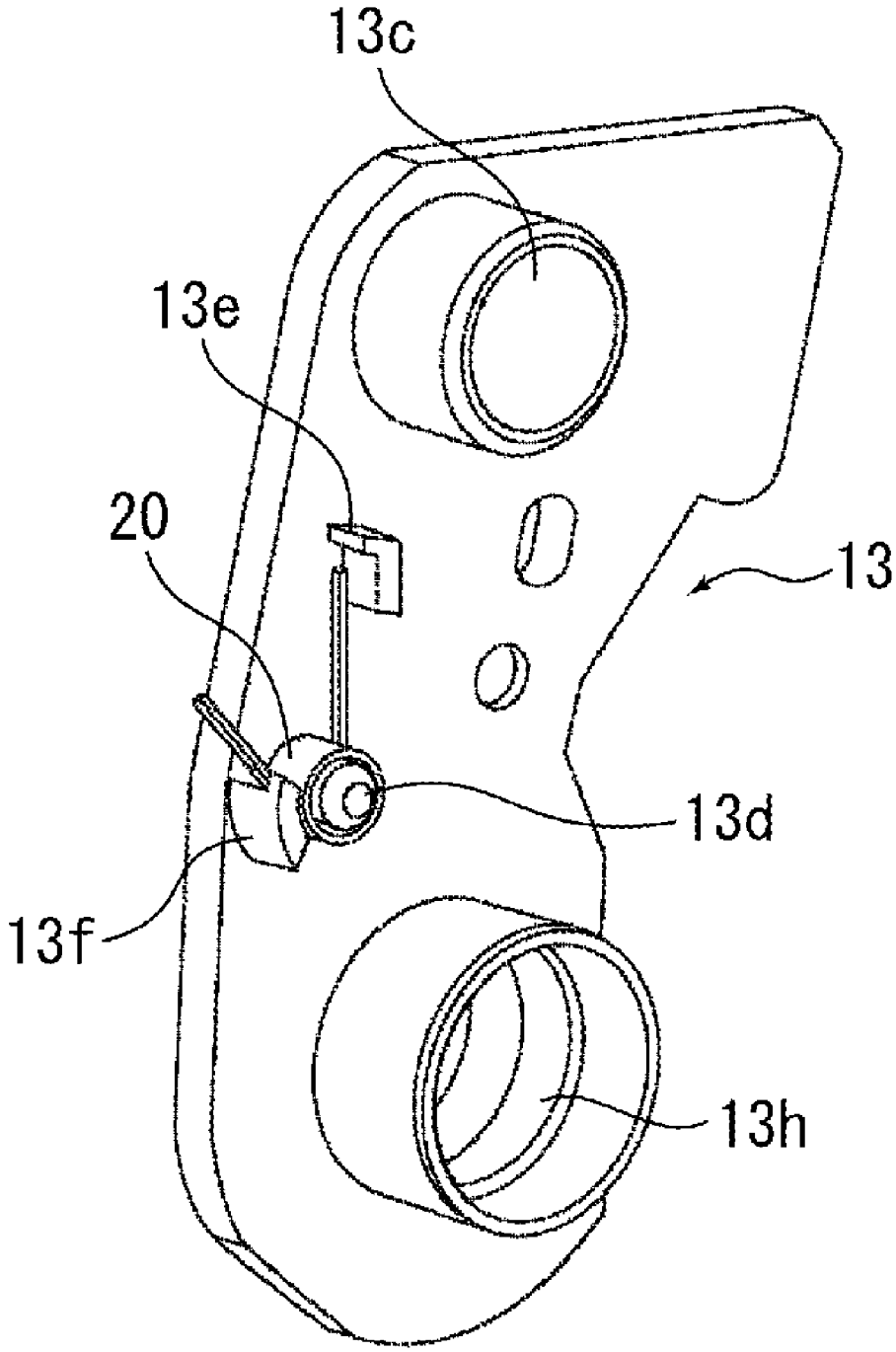
FIG. 9 is a perspective view illustrating a supporting member in the process cartridge according to an exemplary embodiment of the present invention.

The supporting member 13 is provided with a biasing spring 20 as illustrated in FIG. 9. The biasing spring 20 urges the protective shutter 12, which is attached to the photosensitive member unit v, to a protective position at which the photosensitive drum 7 is covered with the protective shutter 12. In the present exemplary embodiment, the biasing spring 20 is a torsion coil spring.

The biasing spring 20 is mounted in a state in which a boss 13*d* and two spring holders 13*e* and 13*f*, which are provided on the supporting member 13, are applied with an elastic force. The supporting member 13 is attached to the cleaning frame member 11, to which the developing unit u has been attached.

Figure 10:
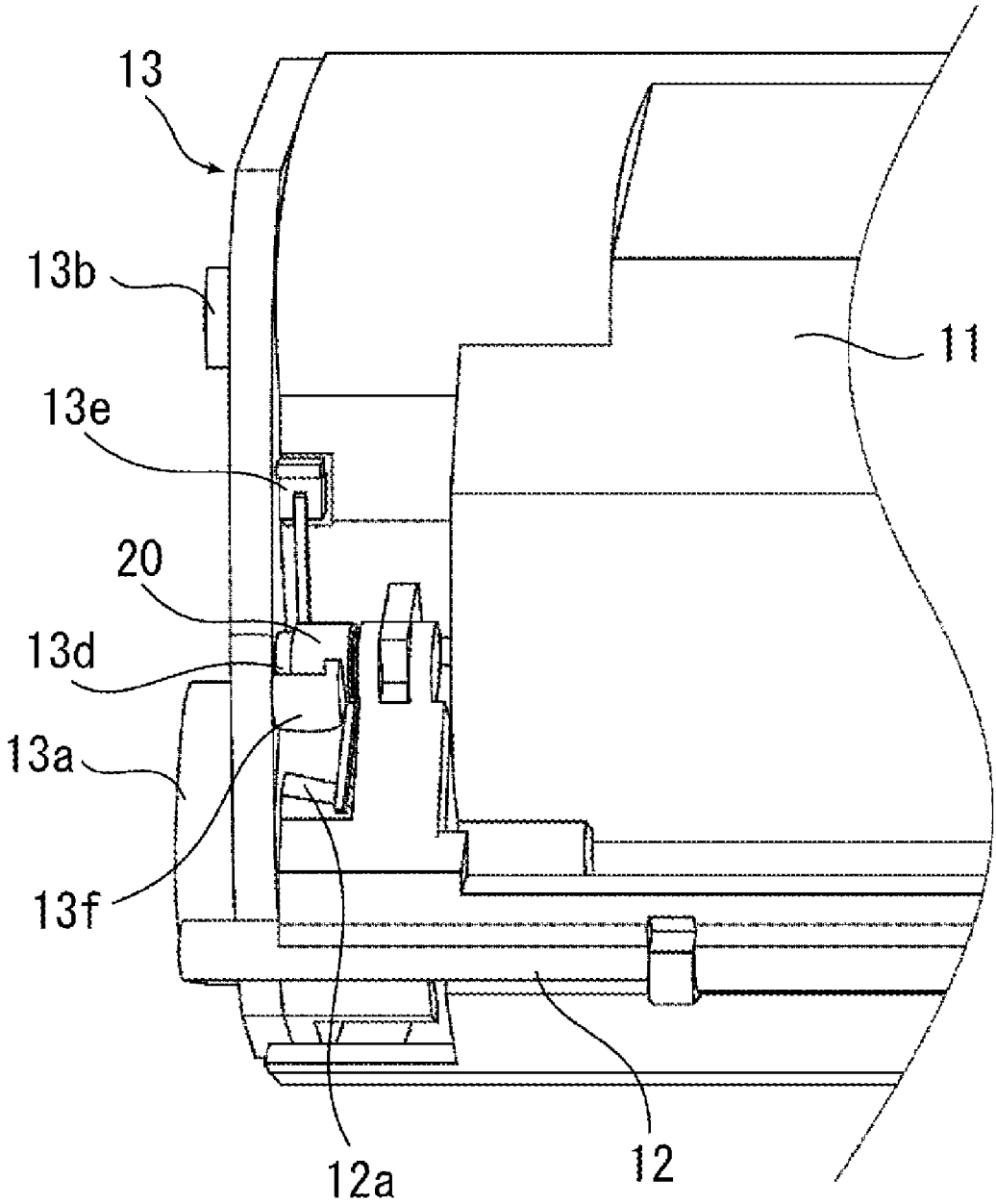
FIG. 10 is a perspective view illustrating the supporting member and a protective shutter member in the process cartridge according to an exemplary embodiment of the present invention.

In addition, the protective shutter 12 is rotatably attached to the photosensitive member unit v. In this state, the protective shutter 12 is moved in a direction to expose the photosensitive drum 7. Thus, a spring holder 12*a* of the protective shutter 12 contacts the biasing spring 20, as illustrated in FIG. 10. Then, the biasing spring 20 is released from the spring holder 13*f* of the supporting member 13 to apply pressure to the protective shutter 12.

The spring holder 12*a* has a slant in a direction to move the biasing spring 20 towards a center portion in the longitudinal direction. Accordingly, when the protective shutter 12 is opened and closed, the biasing spring 20 is released from the spring holder 13*f* of the supporting member 13.

Figure 11:
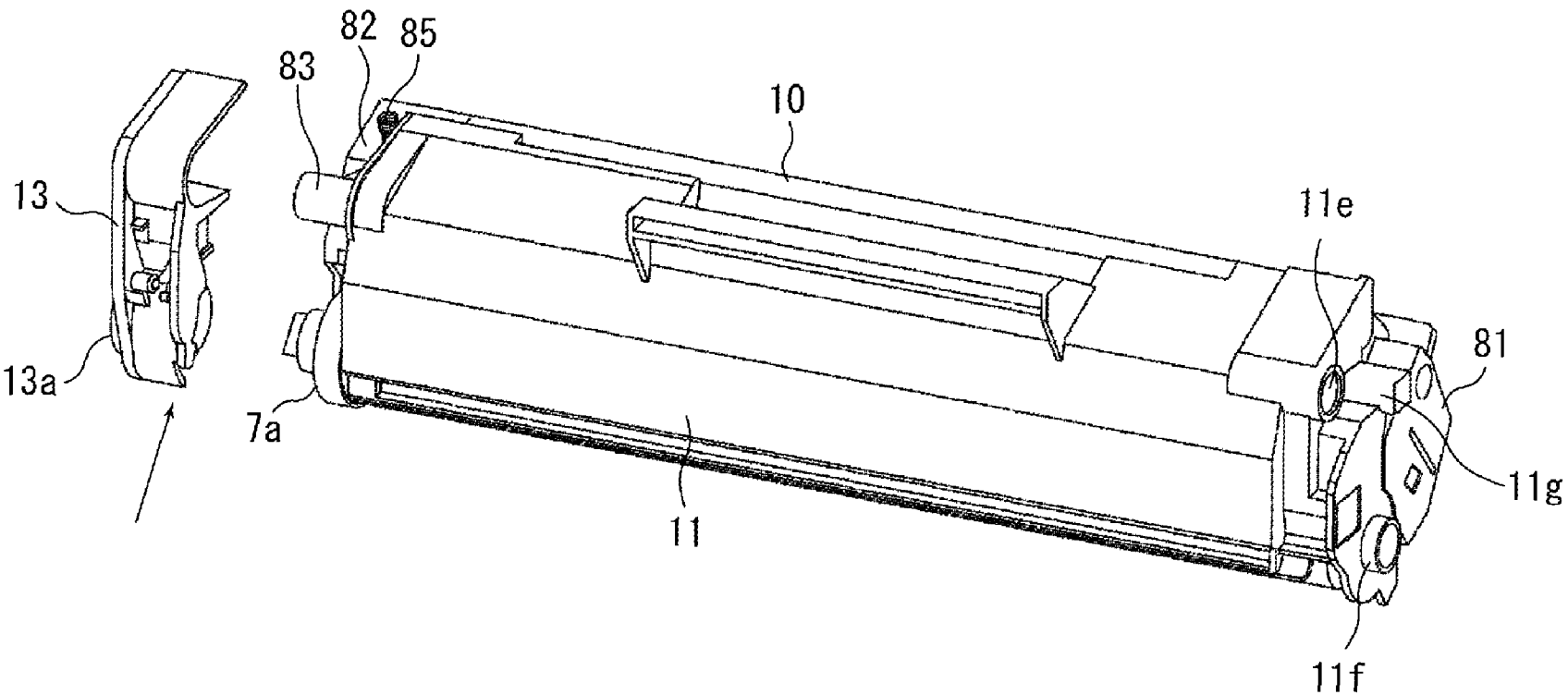
FIG. 11 is a perspective view illustrating a method for disassembling the process cartridge according to an exemplary embodiment of the present invention.
Figure 12:
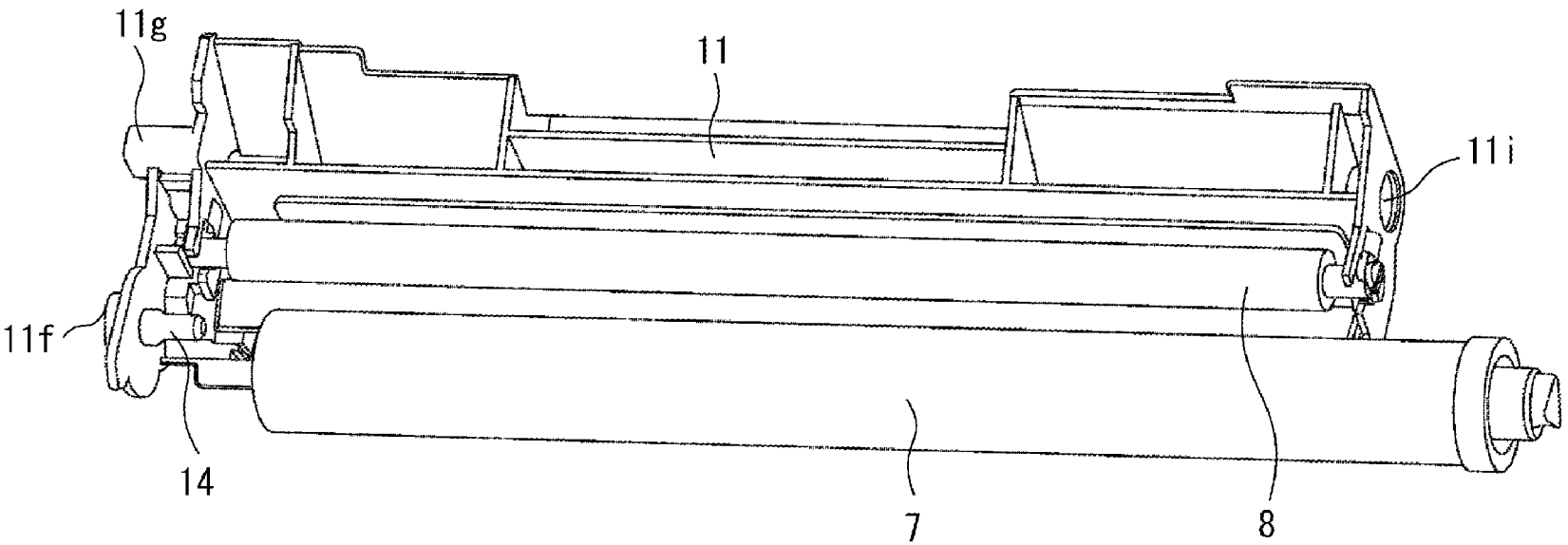
FIG. 12 is a perspective view illustrating a method for disassembling the process cartridge according to an exemplary embodiment of the present invention.

A method for disassembling the process cartridge B will now be described with reference to FIG. 11 and FIG. 12.

i) Supporting Member Detaching Step

In the present exemplary embodiment, first, the supporting member 13 is detached from the photosensitive unit v (the cleaning frame member 11). That is, the fitting hole 13*c* is separated from the fulcrum shaft 82*b* at the other end, and the shaft bearing portion 13*h* is separated from the photosensitive drum 7 at the other end.

Thus, the guide boss 86 is engaged into the guide hole 11*i*, and the development frame body is temporarily supported by the cleaning frame member 11 at the other end. Thus, the photosensitive member unit v (the cleaning frame member 11) and the developing unit u (the development frame member) can be detached from each other.

Accordingly, when the supporting member 13 is detachably attached to the cleaning frame member 11 with a screw, the supporting member 13 can be easily detached by pulling out the screw. On the other hand, when limonene bonding or resin bonding is used to assemble the supporting member 13 with a high level of assembling strength, the cleaning frame member 11, to which the supporting member 13 is integrally fixed, is cut in the vicinity of a position indicated by an arrow in FIG. 11 to detach the supporting member 13.

Thus, the cleaning frame member 11 and the development frame member can be detached from each other. As illustrated in FIG. 12, the photosensitive drum 7, the charging roller 8, and the cleaning blade 11*a* can also be easily detached.

ii) Frame Member Detaching Step

Then, the development frame member is slid from the one end to the other end in the longitudinal direction with respect to the cleaning frame member 11. Thus, the fulcrum shaft 81*b* is separated from the fitting hole 11*e* at the one end, and the guide boss 86 is separated from the guide hole 111 at the other end. Then, the developing unit u (the development frame member) is detached from the photosensitive member unit v in a direction crossing the longitudinal direction.

iii) Photosensitive Member Detaching Step

Subsequently, the photosensitive drum 7 is detached from the photosensitive member unit v at the one end.

As described above, according to the present exemplary embodiment, fulcrum shafts provided on both ends of a developing unit in the longitudinal direction are swingably supported by a cleaning frame member and a supporting member. Thus, a process cartridge can be easily configured without the needing a connection pin. Furthermore, positioning of the developing unit in the longitudinal direction is determined with the supporting member. Thus, the process cartridge can be easily disassembled by detaching the supporting member.

According to the present exemplary embodiment, a portion to be supported and provided on a second unit, including a developing member, can be rotatably supported by a first unit, including an electrophotographic photosensitive member and a supporting member.

In addition, according to the present exemplary embodiment, a process cartridge can have a simple configuration without using a relatively large number of parts.

Furthermore, according to the present exemplary embodiment, a process cartridge can be disassembled by detaching a supporting member. Thus, workability can be increased at the time of recycling primary component parts. Moreover, according to the present exemplary embodiment, no connection pin is required.

As described above, according to the present exemplary embodiment, the number of parts of a process cartridge can be reduced. Moreover, according to the present exemplary embodiment, a process cartridge can be easily assembled. Furthermore, according to the present exemplary embodiment, a process cartridge can be easily disassembled.

INDUSTRIAL APPLICABILITY

As described hereinabove, according to the present invention, it is possible to provide a process cartridge having reduced number of parts. Further, it is also possible to provide a process cartridge that can be easily assembled and disassembled.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

The invention claimed is:

1. A process cartridge detachably mountable to an image forming apparatus, said process cartridge comprising:

an electrophotographic photosensitive member;

developer carrying member for carrying a developer to develop an electrostatic latent image formed on said electrophotographic photosensitive member;

a development frame member rotatably supporting first and second longitudinal ends of the developer carrying member;

a photosensitive member frame member rotatably supporting said electrophotographic photosensitive member at one longitudinal end portion of said process cartridge and swingably supporting said development frame member at said one end portion; and a supporting member mounted to said photosensitive member frame member at the other longitudinal end portion of said process cartridge, said supporting member directly rotatably supporting said electrophotographic photosensitive member at said other end portion and swingably supporting said development frame member at said other end portion.

2. A process cartridge according to claim 1, wherein said development frame member includes a first-end supported portion at said one end portion and a second-end supported portion at said other end portion, wherein said photosensitive member frame member includes a first-end supporting portion swingably supporting the first-end supported portion at said one end portion, and wherein said supporting member includes a first supporting portion swingably supporting the second-end supported portion.

3. A process cartridge according to claim 2, wherein said photosensitive member frame member includes a photosensitive member supporting portion rotatably supporting said electrophotographic photosensitive member at said one end portion, and wherein said supporting member includes a second supporting portion rotatably supporting said electrophotographic photosensitive member at said other end portion.

4. A process cartridge according to claim 3, wherein said supporting member includes a restricting portion for restricting movement of said development frame member in the longitudinal direction.

5. A process cartridge according to claim 4, wherein said development frame member includes a restricted portion at said other end portion restricted by the restricting portion, and wherein said photosensitive member frame member includes another restricting portion at said other end portion to restrict movement of said development frame member in the longitudinal direction.

6. A process cartridge according to any one of claims 3-5, wherein said development frame member includes a temporary supported portion at said other end portion, and said photosensitive member frame member includes a temporary supporting portion at said other end portion, and wherein, when said development frame member is supported on said photosensitive member frame member to assemble said process cartridge, the temporary supporting portion temporarily supports the temporary supported portion.

7. A process cartridge according to claim 6, wherein, when the temporary supporting portion temporarily supports the temporary supported portion, said development frame member is positioned relative to said photosensitive member frame member at a position where said first supporting portion is capable of supporting said second-end supported portion and said second supporting portion is capable of supporting said electrophotographic photosensitive member.

8. A process cartridge according to claim 6, wherein a play between the temporary supported portion and the temporary supporting portion is larger than a play between the second-end supported portion and the first supporting portion, such that when said supporting member is mounted to said photosensitive member frame member with said development frame member supported by said photosensitive member frame member, the first supporting portion supports the second-end supported portion without causing the temporary supporting portion to support the temporary supported portion.

9. A process cartridge according to claim 6, wherein the temporary supported portion is disposed coaxially with a center axis of swinging motion of said second-end supported portion.

10. A process cartridge according to any one of claims 3-5, wherein said development frame member includes a temporary supported portion at said other end portion, and said photosensitive member frame member includes a temporary supporting portion at said other end portion, and wherein, when said supporting member is removed from said process cartridge to disassemble said process cartridge, the temporary supporting portion temporarily supports the temporary supported portion.

11. A process cartridge according to claim 10, wherein, when the temporary supporting portion temporarily supports the temporary supported portion, said development frame member is positioned relative to said photosensitive member frame member at a position where said first supporting portion is capable of supporting said second-end supported portion and said second supporting portion is capable of supporting said electrophotographic photosensitive member.

12. A process cartridge according to claim 10, wherein a play between the temporary supported portion and the temporary supporting portion is larger than a play between the second-end supported portion and the first supporting portion, such that when said supporting member is dismounted from said process cartridge, the first supporting portion supports the second-end supported portion without causing the temporary supporting portion to support the temporary supported portion.

13. A process cartridge according to claim 10, wherein the temporary supported portion is disposed coaxially with a center axis of swinging motion of said second-end supported portion.

14. A process cartridge according to any one of claims 2-5, wherein said development frame member includes a developer storage portion for storing a developer to be supplied to the developer carrying member.

15. A process cartridge according to any one of claims 2-5, wherein said photosensitive member frame member includes a removed developer storage portion for storing a removed developer removed from said electrophotographic photosensitive member.

16. A process cartridge according to claim 1, wherein the longitudinal direction of said process cartridge is the longitudinal direction of said electrophotographic photosensitive member.

17. A supporting member for use with a process cartridge, wherein said process cartridge includes an electrophotographic photosensitive member, a developer carrying member for carrying a developer to develop an electrostatic latent image formed on said electrophotographic photosensitive member, a development frame member rotatably supporting first and second longitudinal ends of the developer carrying member, and a photosensitive member frame member rotatably supporting said electrophotographic photosensitive member at one longitudinal end portion of said process cartridge and to swingably supporting said development frame member at said one end portion, the improvement residing in that:

said supporting member is mountable to said photosensitive member frame member at the other longitudinal end portion of said process cartridge, and said supporting member is effective to directly rotatably support said electrophotographic photosensitive member at said other end portion and effective to swingably support said development frame member at said other end portion.

18. A supporting member according to claim 17, comprising:

a first supporting portion for rotatably supporting said electrophotographic photosensitive member at said other end portion; and a second supporting portion for swingably supporting said development frame member at said other end portion.

19. A supporting member according to any one of claim 16 or 18, wherein said supporting member further comprises a restricting portion for restricting movement of said development frame member in the longitudinal direction.

20. A supporting member according to claim 19, further comprising:

a positioning portion for positioning said process cartridge relative to an image forming apparatus when said process cartridge is mounted to the image forming apparatus; and a rotation restricting portion for contacting the image forming apparatus to restrict rotation of said process cartridge around the positioning portion when said process cartridge is mounted to the image forming apparatus.

21. A supporting member according to claim 20, wherein the rotation restricting portion is guided by a guide member provided on the image forming apparatus when said process cartridge is mounted to or dismounted from the image forming apparatus.

22. A supporting member according to claim 17, wherein the longitudinal direction of said process cartridge is the longitudinal direction of said electrophotographic photosensitive member.

23. A method for assembling a process cartridge that is detachably mountable to an image forming apparatus, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member, and a supporting member, said method comprising:

directly rotatably supporting said electrophotographic photosensitive member at one longitudinal end portion of said process cartridge by said photosensitive member frame member;

swingably supporting said development frame member at said one end portion by said photosensitive member frame member;

swingably supporting said development frame member at the other longitudinal end portion of said process cartridge by said supporting member;

directly rotatably supporting said electrophotographic photosensitive member at said other end portion by said supporting member; and mounting said supporting member to said photosensitive member frame member at said other end portion.

24. A method according to claim 23, wherein said development frame member includes a first-end supported portion at said one end portion and a second-end supported portion at said other end portion, said photosensitive member frame member includes a first-end supporting portion at said one end portion, and said supporting member includes a first supporting portion and a second supporting portion, wherein said development frame member supporting step including swingably supporting the first-end supported portion by the first-end supporting portion; and wherein said supporting member mounting step includes swingably supporting the second-end supported portion by the first supporting portion, and rotatably supporting said electrophotographic photosensitive member by the second supporting portion.

25. A method according to claim 24, wherein said development frame member includes a temporary supported portion at said other end portion, and said photosensitive member frame member includes a temporary supporting portion at said other end portion, wherein said development frame member mounting step includes temporarily supporting the temporary supported portion by the temporary supporting member, and wherein said supporting member mounting step includes swingably supporting the second-end supported portion by the first supporting portion to cause the temporary supporting portion not to support the temporary supported portion.

26. A method according to claim 25, wherein the temporary supported portion is disposed coaxially with a center axis of swinging motion of said second-end supported portion.

27. A method according to claim 25, further comprising positioning, after said development frame member supporting step and before said supporting member mounting step, said development frame member relative to said photosensitive member frame member at a position where the first supporting portion is capable of supporting the second-end supported portion and the second supporting portion is capable of supporting said electrophotographic photosensitive member.

28. A method according to claim 25, wherein said development frame member supporting step including sliding said development frame member in a direction away from said other end portion toward said one end portion along the longitudinal direction relative to said photosensitive member frame member to cause the first-end supporting portion to support the first-end supported portion and to cause the temporary supporting portion to support the temporary supported portion.

29. A method according to claim 25, wherein said development frame member supporting step includes moving said development frame member in a direction crossing the longitudinal direction relative to said photosensitive member frame member and then sliding said development frame member in a direction away from said other end portion toward said one end portion along the longitudinal direction relative to said photosensitive member frame member to cause the first-end supporting portion to support the first-end supported portion and to cause the temporary supporting portion to support the temporary supported portion.

30. A method according to claim 23, wherein the longitudinal direction of said process cartridge is the longitudinal direction of said electrophotographic photosensitive member.

31. A method for disassembling a process cartridge that is detachably mountable to an image forming apparatus, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member rotatably supporting said electrophotographic photosensitive member at one longitudinal end portion of said process cartridge and swingably supporting said development frame member at the other longitudinal end portion of said process cartridge, and a supporting member mounted to said photosensitive member frame member at said other end portion, said supporting member directly rotatably supporting said electrophotographic photosensitive member at said other end portion and swingably supporting said development frame member at said other end portion, said method comprising:

separating said supporting member from said development frame member and said electrophotographic photosensitive member at said other end portion and detaching said supporting member from said photosensitive member frame member at said other end portion;

detaching said development frame member from said photosensitive member frame member at said one end portion; and detaching said electrophotographic photosensitive member from said photosensitive member frame member at said one end portion.

32. A method according to claim 31, wherein said development frame member includes a first-end supported portion at said one end portion and a second-end supported portion at said other end portion, said photosensitive member frame member includes a first-end supporting portion at said one end portion, and said supporting member includes a first supporting portion and a second supporting portion, wherein said supporting member dismounting step includes separating the first supporting portion from the second-end supported portion and separating the second supporting portion from said electrophotographic photosensitive member, and wherein said development frame dismounting step includes separating the first-end supporting portion from the first-end supported portion.

33. A method according to claim 32, wherein said development frame member includes a temporary supported portion at said other end portion, and said photosensitive member frame member includes a temporary supporting portion at said other end portion, wherein said supporting member dismounting step includes separating the first supporting portion from the second-end supported portion to cause the temporary supporting portion to temporarily support the temporary supported portion.

34. A method according to claim 33, wherein the temporary supported portion is disposed coaxially with a center axis of swinging motion of said second-end supported portion.

35. A method according to claim 32, further comprising positioning, after said supporting member dismounting step and before said development frame member dismounting step, said development frame member relative to said photosensitive member frame member at a position where the first supporting portion is capable of supporting the second-end supported portion and the second supporting portion is capable of supporting said electrophotographic photosensitive member.

36. A method according to claim 33, wherein said development frame dismounting step includes separating the temporary supporting portion from the temporary supported portion.

37. A method according to claim 33, wherein said development frame member dismounting step includes sliding said development frame member in a direction away from said one end portion toward the said other end portion along the longitudinal direction relative to said photosensitive member frame member so as to separate the first-end supporting portion from the first-end supported portion and to separate the temporary supporting portion from the temporary supported portion.

38. A method according to claim 33, wherein said development frame member dismounting step includes sliding said development frame member in a direction away from said one end portion toward said other end portion along the longitudinal direction relative to said photosensitive member frame member so as to separate the first-end supporting portion from the first-end supported portion and to separate the temporary supporting portion from the temporary supported portion, and then moving said development frame member in a direction crossing the longitudinal direction relative to said photosensitive member frame member.

39. A method according to claim 31, wherein the longitudinal direction of said process cartridge is the longitudinal direction of said electrophotographic photosensitive member.

40. A method for assembling a process cartridge, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member, and a supporting member, said method comprising:

swingably supporting said development frame member at one longitudinal end portion of said process cartridge by said photosensitive member frame member and temporarily supporting said development frame member at the other longitudinal end portion of said process cartridge by said photosensitive member frame member; and mounting said supporting member to said photosensitive member frame member to swingably support said development frame member by said supporting member and not to support said development frame member by said photosensitive member frame member.

41. A method according to claim 40, further comprising rotatably supporting said electrophotographic photosensitive member by said photosensitive member frame member at said one end portion, wherein said supporting member mounting step includes rotatably supporting said electrophotographic photosensitive member by said supporting member at said other end portion.

42. A method according to claim 40, further comprising positioning, after said development frame member supporting step and before said supporting member mounting step, said development frame member relative to said photosensitive member frame member at a position where the supporting member is capable of supporting said development frame member and said electrophotographic photosensitive member at said other end portion.

43. A method according to claim 40, wherein the longitudinal direction of said process cartridge is the longitudinal direction of said electrophotographic photosensitive member.

44. A method for disassembling a process cartridge that is detachably mountable to an image forming apparatus, wherein said process cartridge includes an electrophotographic photosensitive member, a developer carrying member for carrying a developer to develop an electrostatic latent image formed on said electrophotographic photosensitive member, a development frame member supporting first and second longitudinal ends of the developer carrying member, a photosensitive member frame member rotatably supporting said electrophotographic photosensitive member at one longitudinal end portion of said process cartridge and swingably supporting said development frame member at the other longitudinal end of said process cartridge, and a supporting member mounted to said photosensitive member frame member at said other end portion, said supporting member rotatably supporting said electrophotographic photosensitive member at said other end portion and swingably supporting said development frame member at said other end portion, said method comprising:

separating said supporting member from said development frame member and said electrophotographic photosensitive member at said other end portion and thereby temporarily supporting said development frame member by said photosensitive member frame member at said other end portion, and dismounting said supporting member from said photosensitive member frame member at said other end portion; and dismounting said development frame member from said photosensitive member frame member at said one end portion and said other end portion.

45. A method according to claim 44, further comprising dismounting said electrophotographic photosensitive member from said photosensitive member frame member at said one end portion, wherein said supporting member dismounting step includes rotatably supporting said electrophotographic photosensitive member by said supporting member at said other end portion.

46. A method according to claim 44, further comprising positioning, after said supporting member dismounting step and before said development frame member dismounting step, said development frame member relative to said photosensitive member frame member at a position where the supporting member is capable of supporting said development frame member and said electrophotographic photosensitive member at said other end portion.

47. A method according to claim 44, wherein the longitudinal direction of said process cartrige is the longitudinal direction of said electrophotographic photosensitive member.

* * * * *